US011753117B2

(12) United States Patent
Steininger et al.

(10) Patent No.: US 11,753,117 B2
(45) Date of Patent: Sep. 12, 2023

(54) COLLAPSABLE ANCHOR

(71) Applicant: SandShark, Inc., Plymouth, IN (US)

(72) Inventors: Jeffrey Alan Steininger, St. Marys, OH (US); Duane Mattix, Plymouth, IN (US)

(73) Assignee: SANDSHARK, INC., Plymouth, IN (US)

( * ) Notice: Subject to any disclaimer, the term of this patent is extended or adjusted under 35 U.S.C. 154(b) by 176 days.

(21) Appl. No.: 17/397,427

(22) Filed: Aug. 9, 2021

(65) Prior Publication Data

US 2023/0043734 A1 Feb. 9, 2023

(51) Int. Cl.
*B63B 21/24* (2006.01)
*B63B 21/26* (2006.01)
*B63B 21/34* (2006.01)

(52) U.S. Cl.
CPC ..... *B63B 21/243* (2013.01); *B63B 21/26* (2013.01); *B63B 21/34* (2013.01); *B63B 2021/262* (2013.01)

(58) Field of Classification Search
CPC ..... B63B 21/24; B63B 21/243; B63B 21/26; B63B 2021/262; B63B 21/34; B63B 21/36; B63B 21/44
USPC ..... 114/294, 298, 304
See application file for complete search history.

(56) References Cited

U.S. PATENT DOCUMENTS 3,306,248 A 2/1967 Austin
3,485,199 A 12/1969 Schuman
3,822,664 A * 7/1974 Hedman ..... B63B 21/44 114/305
4,579,077 A * 4/1986 Soules ..... B63B 21/243 114/304
4,596,202 A 6/1986 Brewster
5,188,055 A 2/1993 Kershner
5,529,023 A 6/1996 Boardman
5,850,802 A 12/1998 Dvorak
6,119,618 A 9/2000 Giles
6,626,123 B1 9/2003 MacKarvich
9,764,798 B1 * 9/2017 Voelker ..... B63B 21/42

OTHER PUBLICATIONS

On-line product catalog featuring boat anchor accessories, Amazon.com, Inc., 7 pages, Aug. 5, 2021.

(Continued)

*Primary Examiner* — Daniel V Venne
(74) *Attorney, Agent, or Firm* — Thompson Hine LLP

(57) ABSTRACT

An anchor system including an anchor having a body member and a first arm pivotally coupled to the body member. The first arm is movable between a closed position wherein the first arm is positioned adjacent to the body member and an open position wherein at least part of the first arm is spaced away from the body member. The system further includes a second arm pivotally coupled to the body member and movable between a closed position wherein the second arm is positioned adjacent to the body member and an open position wherein at least part of the second arm is spaced away from the body member. At least one of the first or second arms has a cavity that is exposed when the at least one of the first or second arms is in the open position. The at least one of the first or second arms includes a protrusion extending therefrom.

19 Claims, 8 Drawing Sheets

(56) References Cited

OTHER PUBLICATIONS

On-line product catalog featuring folding anchors, Austin Kayak, LLC, 20 pages, Aug. 5, 2021.
On-line product literature featuring "K5 Kayak/Canoe Anchor—3.5 Lbs," Tightline Anchor, 15 pages, Aug. 5, 2021.

* cited by examiner

COLLAPSABLE ANCHOR

The present disclosure is directed to an anchor for use with a water vessel, and more particularly, to an anchor that is collapsable.

BACKGROUND

Anchors are widely used to secure boats and other water vessels to the sea/lake/river floor, shore, beaches, etc. However many anchors are relatively heavy and/or bulky and thus can be difficult to store and/or transport.

SUMMARY

In one embodiment the present disclosure is directed to an anchor which can be moved between a collapsed position and expanded position, and/or which has a cavity to receive sand or other loose debris therein to add weight and resistance to dislodging when the anchor is in use. More particularly, in one embodiment the invention is an anchor system including an anchor having a body member and a first arm pivotally coupled to the body member. The first arm is movable between a closed position wherein the first arm is positioned adjacent to the body member and an open position wherein at least part of the first arm is spaced away from the body member. The system further includes a second arm pivotally coupled to the body member and movable between a closed position wherein the second arm is positioned adjacent to the body member and an open position wherein at least part of the second arm is spaced away from the body member. At least one of the first or second arms has a cavity that is exposed when the at least one of the first or second arms is in the open position. The at least one of the first or second arms includes a protrusion extending therefrom.

DETAILED DESCRIPTION

Figure 1:
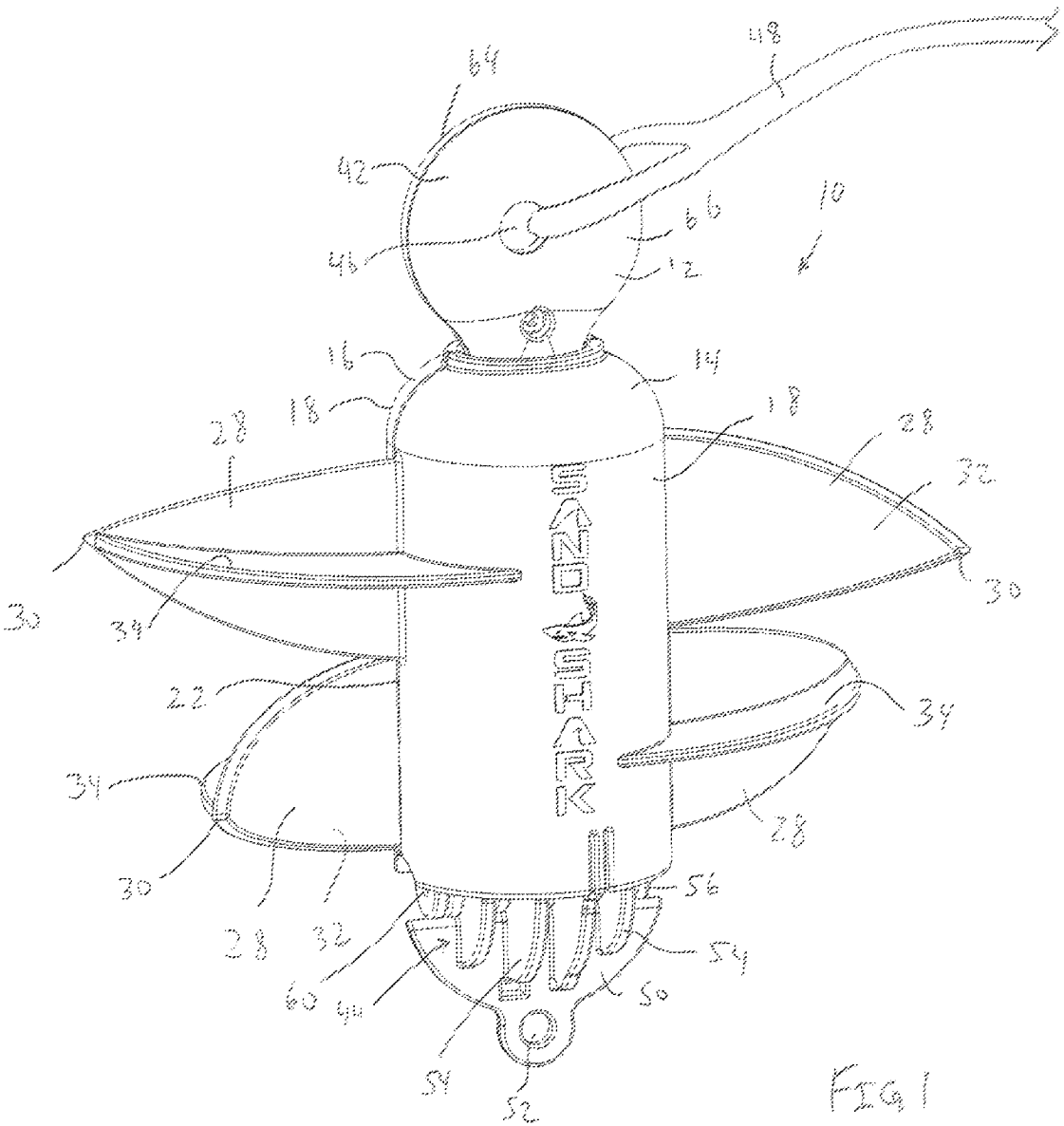
FIG. 1 is a front perspective view of an embodiment of the anchor in a collapsed/storage position.

With reference to FIGS. 1-8 the anchor disclosed herein, generally designated 10, can include a central body member 12, and a first arm 14 and second arm 16 movably coupled to the body member 12. Each arm 14, 16 is, in one case, pivotally coupled to the body member 12 and movable/pivotable between a closed (or collapsed/storage) position wherein the arm 14, 16 is positioned adjacent to and parallel with the body member 12, as shown in FIG. 1, and an open (or expanded/use) position wherein at least part of the arm 14, 16 is spaced away from the body member 12 and arranged at an angle (FIGS. 2-5). Each arm 14, 16 can be pivotally coupled to the body member 12 about a pivot connection and pivotable about a pivot axis A (FIG. 2) between the open and closed positions. The body member 12 may include a longitudinal/central axis B, and each arm 14, 16 can include its own longitudinal/central axis C. Each arm 14, 16 can have a length along its central axis C that less than a length of the body member 12 along its central axis B, and in one case each arm 14, 16 has a length that at least about fifty percent of the length of the body member 12 (along axis B), and in another embodiment has a length that is at least about seventy five percent of the length of the body member 12.

When each arm 14, 16 is in the closed position (FIG. 1), the axis C of each arm 14, 16 can be oriented generally parallel to the central axis B of the central body member 12, and when each arm is in the open position (FIGS. 2-5) each axis C can be oriented generally perpendicular to the central axis B of the body member 12. In this manner, each arm 14, 16 can be pivotable about ninety degrees in one case between its open and closed position. However, it should be understood that each arm 14, 16 can be pivotable by amounts greater than and/or less than ninety degrees as desired, such as at least about forty-five degrees in one case.

Each arm 14, 16 is, in the illustrated embodiment, generally shaped as half a cylinder on its outer surface, having a curved outer surface or outer shell 18 defining a cavity 20 therein. Each cavity 20 can be a concave shape which can, in one case, store/retain material therein when the anchor 10 is in its upright position shown in FIG. 2. The outer surface 18 of each arm 14, 16 (e.g. the half cylinder shape) can be a relatively thin shell material, defining an outer edge 22 extending at least partially around a perimeter of the cavity 20 and parallel to the axis C. A series of ribs or stiffening members 24 can be positioned in each cavity 20 to provide strength/support to the associated cavity 20. The dimensions of each arm 14, 16/cavity 20 can vary as desired, but in one case each arm 14, 16/cavity 20 has a volume of at least about three cubic inches, or at least about nine cubic inches in another case, to provide sufficient volume to receive sand and other loose material therein to provide additional anchoring properties and/or weight to the anchor 10, as will be described in greater detail below.

Each arm 14, 16 can include a pair of protrusions 28 positioned at/coupled to the outer edge 22 of the associated cavity 20. Each protrusion 28 is, in the illustrated embodiment, generally triangular in top/front view. In this manner each protrusion 28 can have a pointed tip 30, a base E, and a length L (FIG. 5, which in the illustrated embodiment is the longest dimension of the protrusion 28, but need not necessarily be) oriented perpendicular to the base E/outer edge 22, extending along a greatest dimension of the protrusion 28 in one case. Each protrusion 28 (e.g. along its length L in one case) can be oriented generally perpendicular to a length of the arm 14, 16/cavity 20 along the axis C. Each protrusion 28 (along its length L) can be oriented generally perpendicular to the axis B of the body member 12, particularly when the associated arm 14, 16 is in the open position. The length L of each protrusion 28 is in one case equal to at least about fifty percent of the length of the arm 14, 16/cavity 20, and in another case least about seventy five percent of the length of the arm 14, 16/cavity 20. The length L of each protrusion 28 is in one case equal to at least about fifty percent of the length of the body member 12 (along axis B), and in another case least about seventy five percent of the length of the body member 12.

Each protrusion 28 can be curved/arcuate along at least some or all of its length. More particularly, the major surface/face 32 of the protrusion 28 (the largest surface(s) of the protrusion 28) can be curved about an axis D (FIGS. 2, 6 and 7) oriented generally perpendicular to the axis A (regardless of the pivoted position of the arm 14, 16) and/or oriented generally perpendicular to the axis B of the body member (when the arm 14, 16 is in its open position). If desired the protrusions 28 can be generally straight/angled. However providing protrusions 28 that are curved can help the protrusions 28 to dig into the anchor surface 29, since the anchor 10 may naturally want to pivot about axis D or an axis oriented parallel to axis D when the anchor 10 burrows in the anchor surface 29. Each protrusion 28 can include a stiffening rib 34 positioned generally perpendicular to the major surface 32 of the protrusion 28, and coupled to an outer surface of the outer shell 18 of each arm 14, 16, to provide stiffness/stability to the protrusion 28. Each protrusion 28 and/or face 32 can have a surface area of at least about two square inches in one case, or at least about four square inches in another case.

Figure 6:
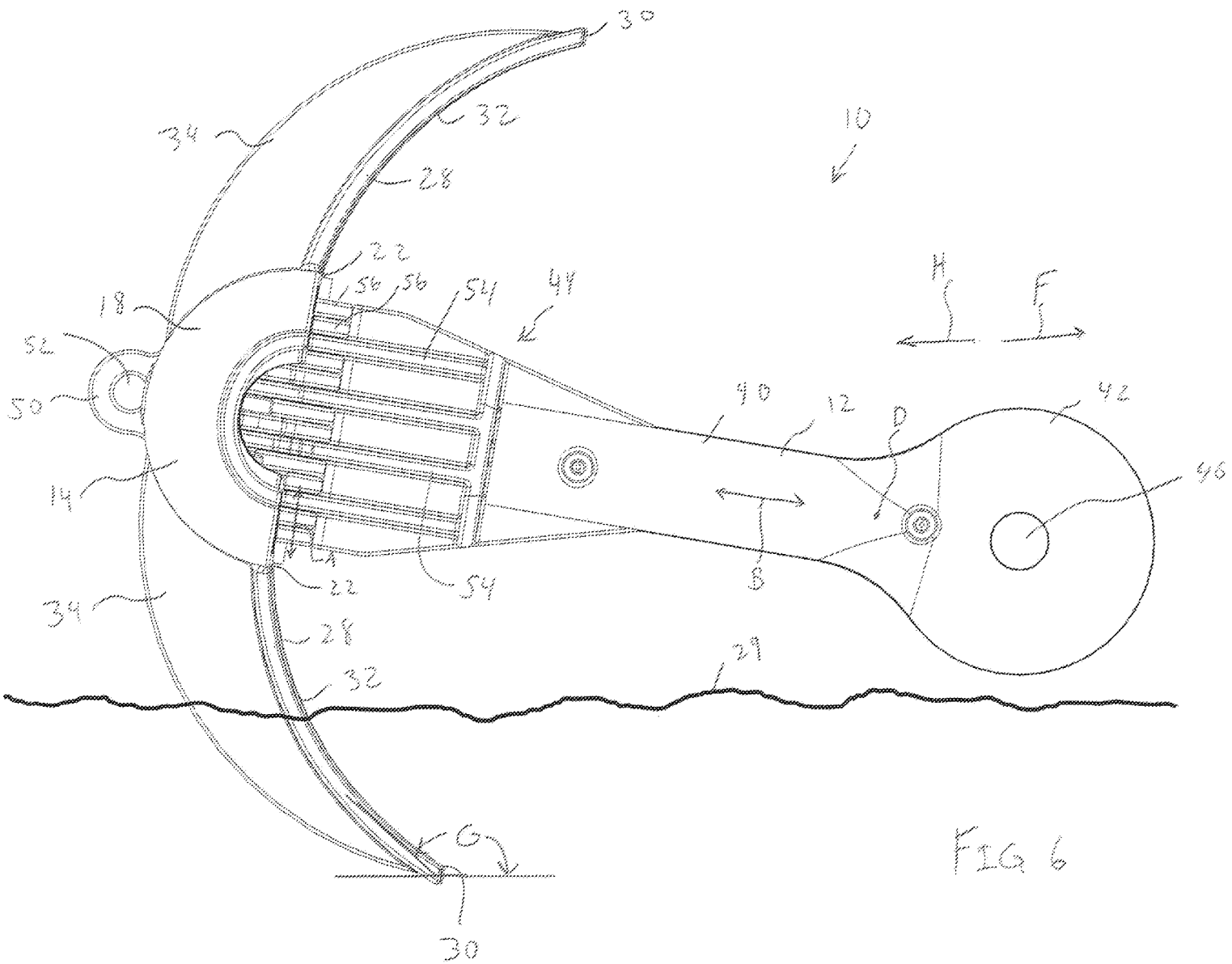
FIG. 6 is a side view of the anchor of FIG. 2 in a dragging position.

Each protrusion 28 can be configured and positioned to cause sand or other loose debris from a sea/lake/river floor, shore, beach etc. (collectively termed an "anchor surface" 29 herein) to be scooped or directed into the associated cavity 20 by the protrusion 28 and/or cause the anchor 10 to at least partially burrow into the anchor surface 29 when the associated arm 14, 16 is in its open position, and when the anchor 10 is dragged across the anchor surface 29. In particular, as shown in FIG. 6 when the anchor 10 is in the dragging position as shown therein the anchor 10 is dragged forwardly in the direction of arrow F across the anchor surface 29. When in the dragging and/or anchor position the body member 12 and/or its central axis B can be oriented generally horizontally and/or generally parallel to the anchor surface 29 (e.g. in one case within +/−20 degrees). When in this position the tip 30 of each protrusion 28 is extends or is angled rearwardly (e.g. at an obtuse angle G) with respect to the forward direction F to enable each tip 30/protrusion 28 to burrow into the anchor surface 29. In one case the angle G (measured at the tip 30 or within an outer 10% of the length of the protrusion 28) is between about 100 degrees and about 170 degrees, and more particularly between about 120 and about 150 degrees.

Figure 7:
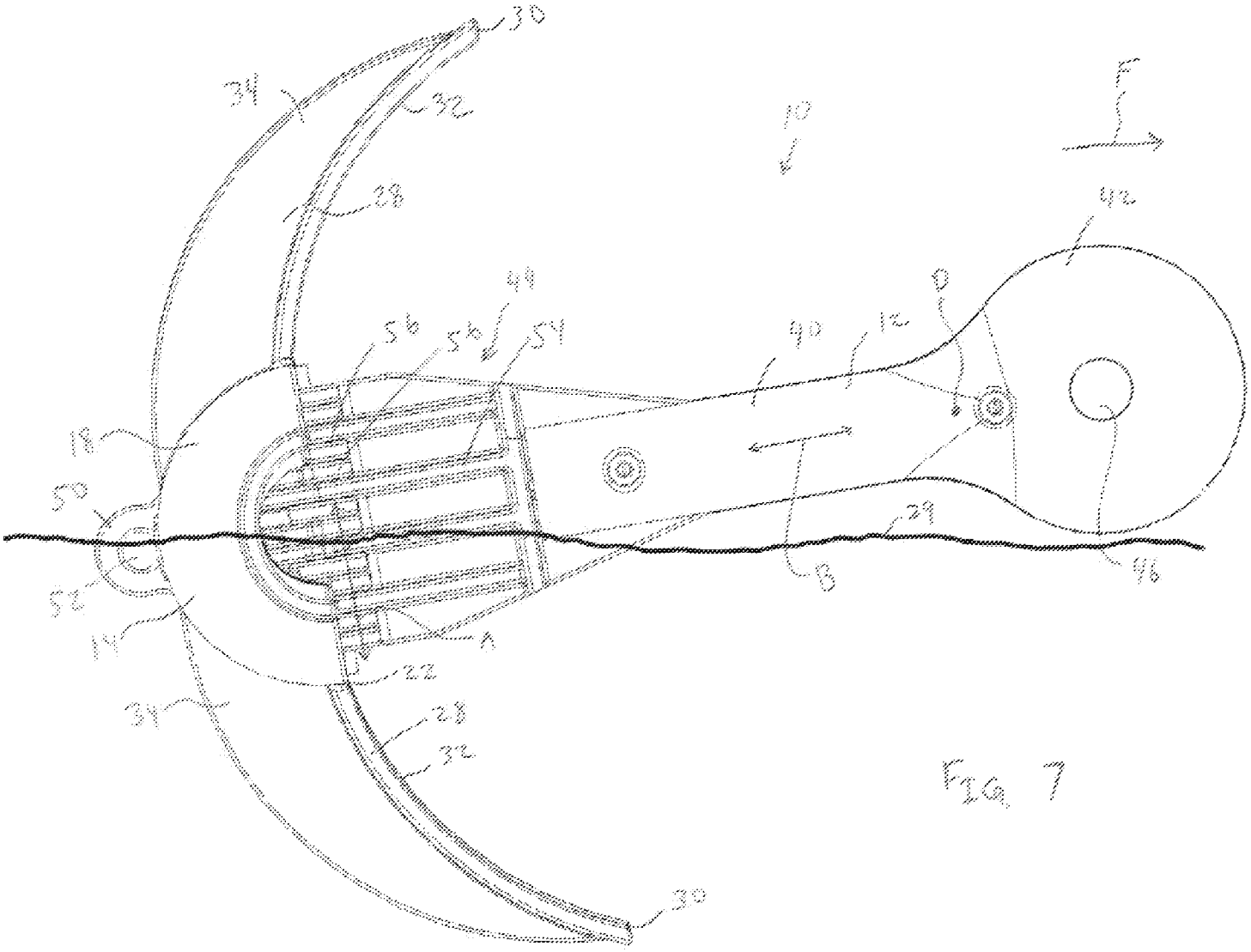
FIG. 7 is a side view of the anchor of FIG. 6 in an anchored position.

Each protrusion 28 can act as a "scoop" when the anchor 10 is dragged to scoop sand or loose debris upwardly and thereby inwardly toward the associated cavity 20 and/or act as a penetrating surface to cause each protrusion 28 to burrow into the anchor surface 29. Once the anchor 10 is sufficiently set, as shown in FIG. 7, the associated arm 14, 16 may be burrowed to a sufficient depth to be at least partially positioned below an upper surface of the anchor surface 29 and/or sand or other loose debris can then settle into and/or be trapped by the cavity 20, adding additional weight to the anchor 10 to help secure the anchor 10 in place. In addition, the outer edges 22 of each arm 14, 16/cavity 20 can also be oriented generally parallel to the anchor surface 29 and "dig into" the anchor surface 29 to thereby enable the arm 14/16 to burrow itself and/or scoop/direct material into the associated inner cavity 20. Any sand or other loose debris can be emptied from the cavities 20 when the anchor 10 is not it use and/or in its closed position. In this manner, when the anchor 10 is not in use, the anchor 10 can be relatively light compared to when the anchor 10 is used, for easier handling and maneuverability, and the effective weight of the anchor 10 can be increased during use.

The illustrated embodiment discloses an anchor 10 with two opposed arms 14, 16, each of which includes two opposed protrusions 28. However, if desired the anchor 10 can include only a single arm 14, 16 and/or each arm(s) 14, 16 can include only a single protrusion 28, if desired, or further alternatively each arm 14, 16 can include more than two protrusions 28, or even further alternatively more than two arms 14, 16 can be used. In any case it may be useful for the anchor 10 to have at least two protrusions 28 that extend outwardly in two different directions (180 degree opposite directions, in one case), which can enable the anchor 10 to be sufficiently anchored into the anchor surface 29 regardless of the direction of pull of the anchor and/or the orientation of the anchor 10. When two (or more) protrusions 28 are included on a single arm 14, 16, the protrusion(s) 28 can be offset along a length of the axis C, particularly with respect to the protrusion 28 of the other arm 14, 16, so that the protrusions 28 of one arm 14 do not contact/engage the protrusions 28 of the other arm 16 when the arms 14, 16 are in their closed positions.

In some cases, the anchor 10 includes only, or exactly, two arms 14, 16. This arrangement can be useful in that the anchor 10 in this configuration will consistently be positioned, in the dragging or anchor positions, in a relatively predictable orientation. This will enable the protrusions 28 to be arranged at a position in which the major surface 32 is oriented generally perpendicular to the anchor surface 29 when the anchor 10 is dragged across the anchor surface 29, as shown in FIG. 6. In one case each protrusion 28 and/or its length dimension L/longest dimension/pointed top 30 is oriented perpendicular or generally perpendicular to the anchor surface 29 when view from the backward direction H shown in FIG. 6. This configuration also enables the arms 14, 16 and their cavities to be oriented parallel to the anchor surface 29 and dig into the anchor surface 29.

Figure 8:
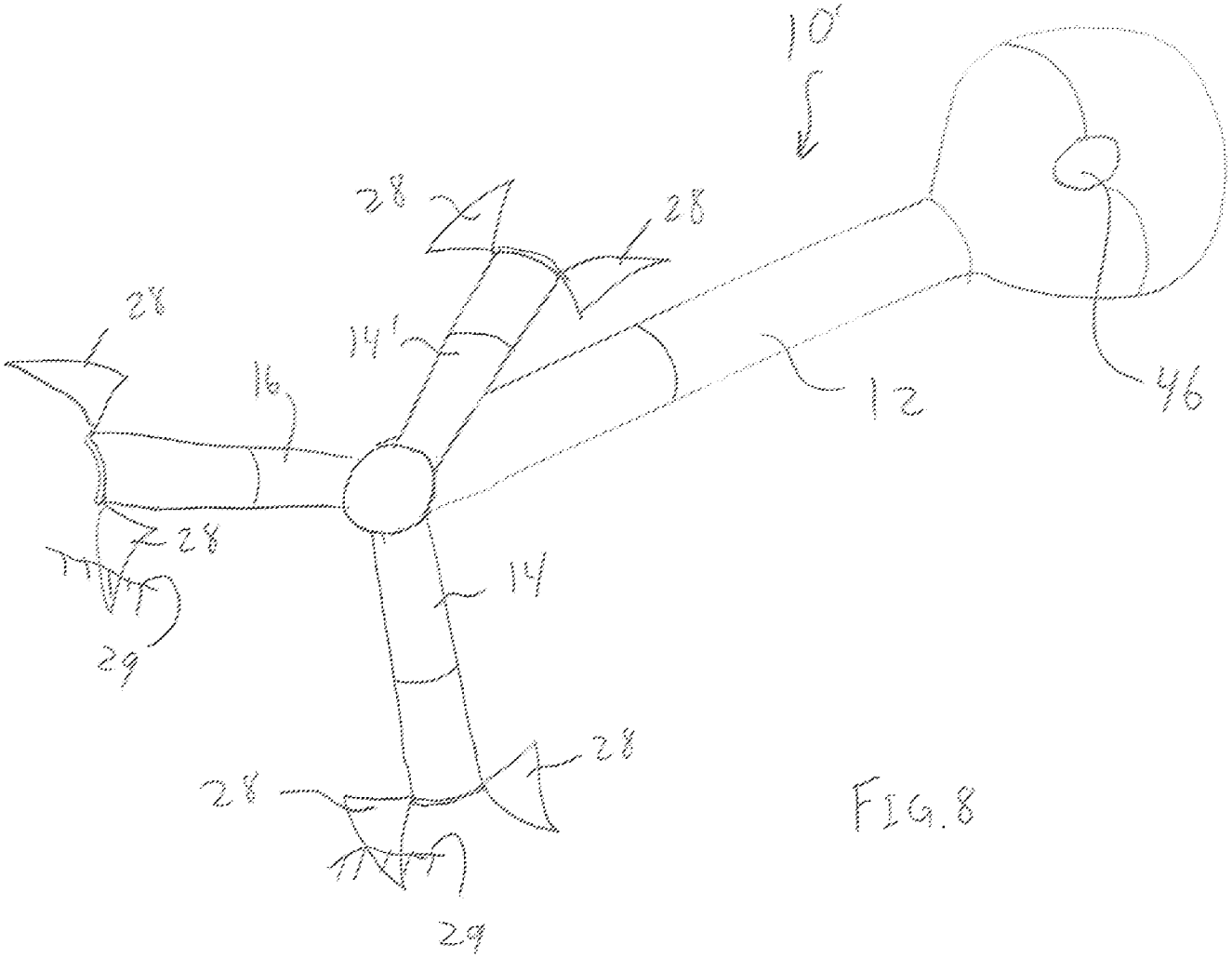
FIG. 8 is a schematic back view of an anchor with three arms in a dragging position.

FIG. 8 is a schematic illustration in which the anchor 10' can include three arms 14, 16, 14', and have protrusions 28 having generally the same qualities as outlined above, but such details are not specifically shown in the schematic drawing of FIG. 8. In this case the arms 14, 16, 14' can be spaced apart on center by 120 degrees. In the arrangement of FIG. 8, when the anchor 10 includes three arms 14, 16, 14', then the anchor 10 would typically rest on only two of the arms (arms 14, 16 in the illustrated embodiment) on the anchor surface 29. In this case the position/angle of the protrusions 28 may need to be varied from that shown in FIGS. 1-7 such that the major surface 32 of at least two protrusions face, and/or are oriented generally perpendicular to, the anchor surface 29 (and/or axis B) when the anchor 10 is in its dragged position. When the anchor 10 includes more than three arms, then the positioning of the protrusions 28 may need to be further adjusted as desired. Thus it may be desired, regardless of the number of arms 14, 16, for the major surface 32 of the protrusions to face the forward direction F and/or the axis B and/or to be oriented generally perpendicular to the anchor surface 29.

Figure 2:
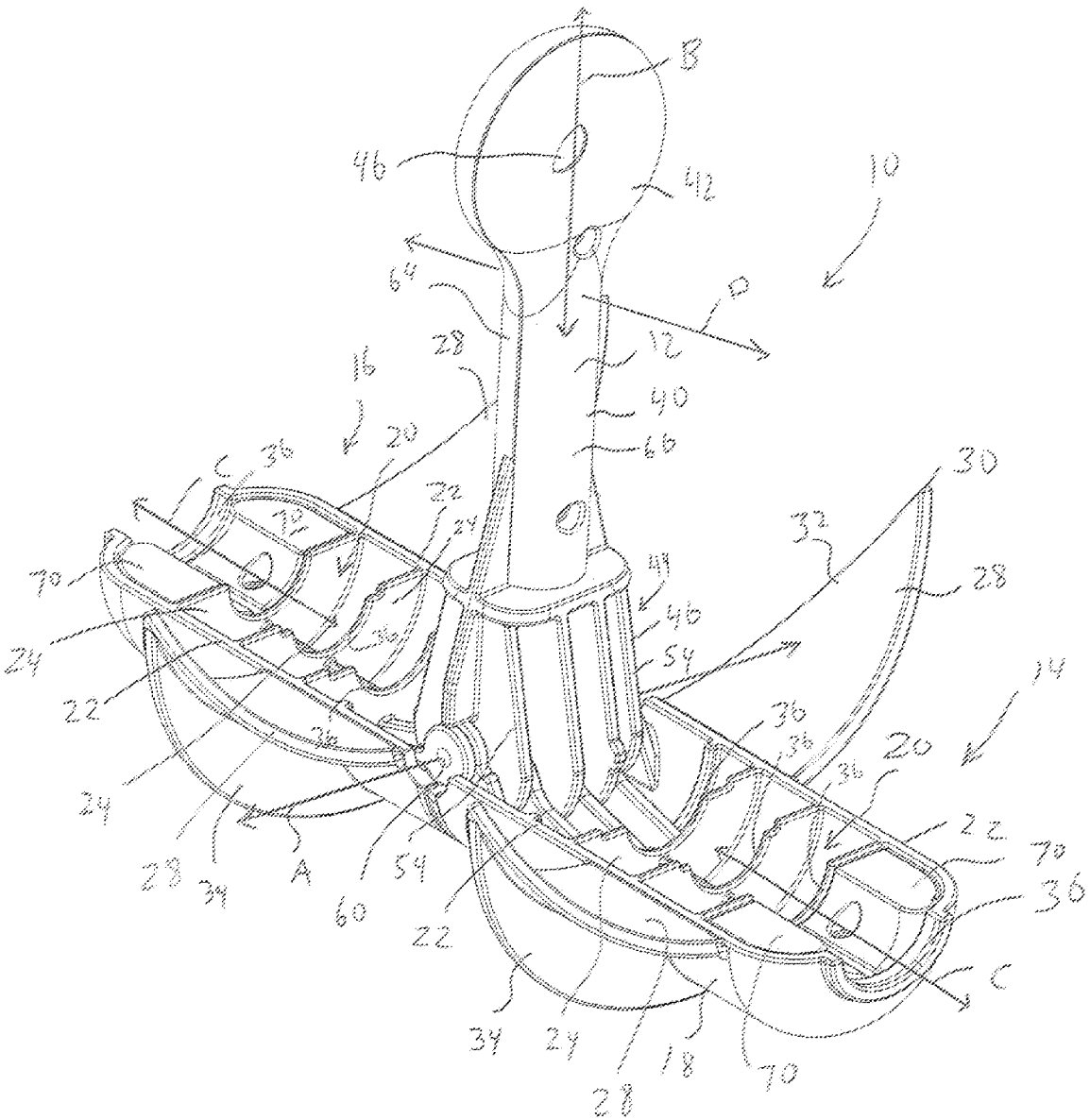
FIG. 2 is a front perspective view of the anchor of FIG. 1, in an expanded/use configuration.
Figure 3:
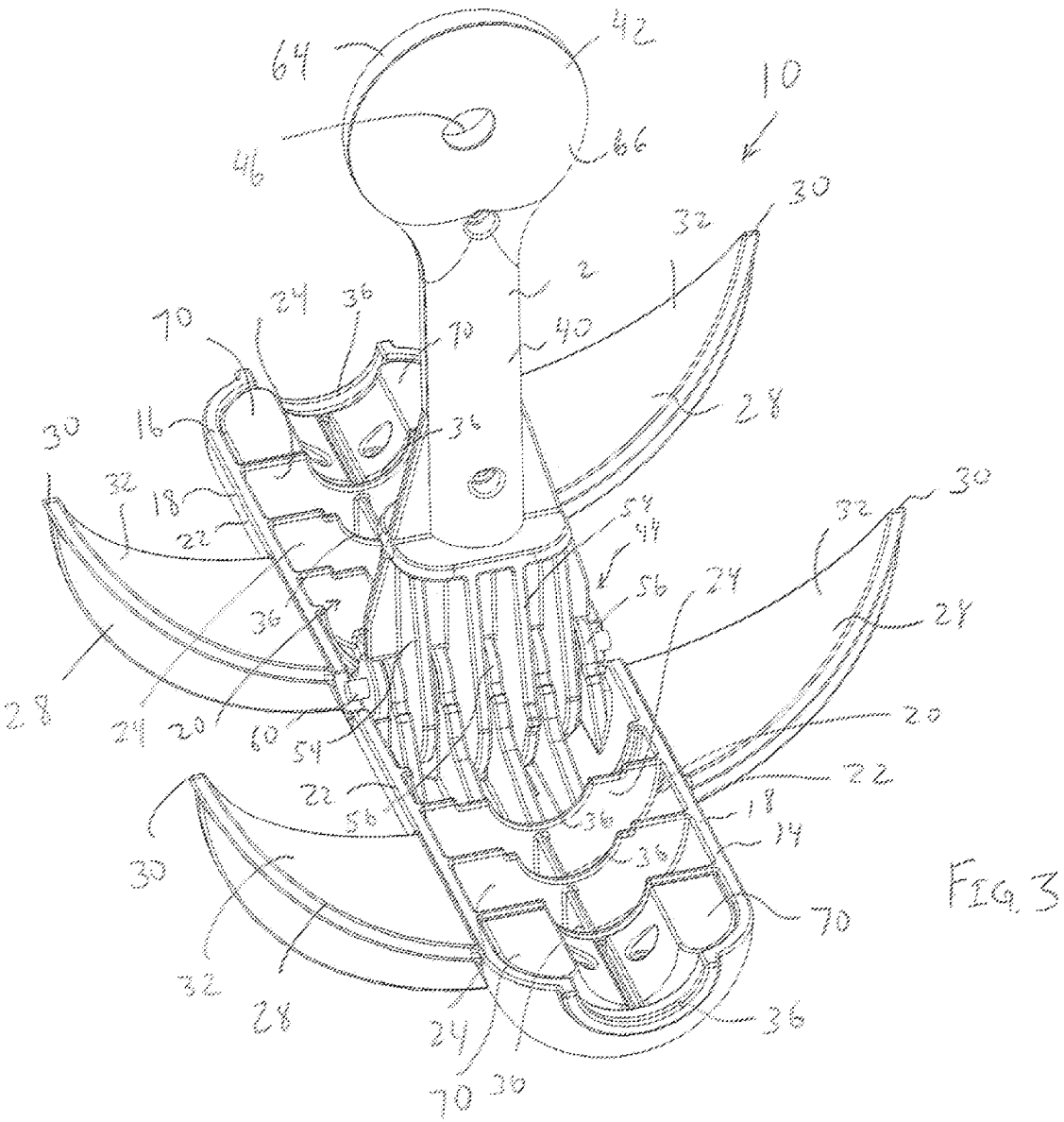
FIG. 3 is another perspective view of the anchor of FIG. 2.
Figure 4:
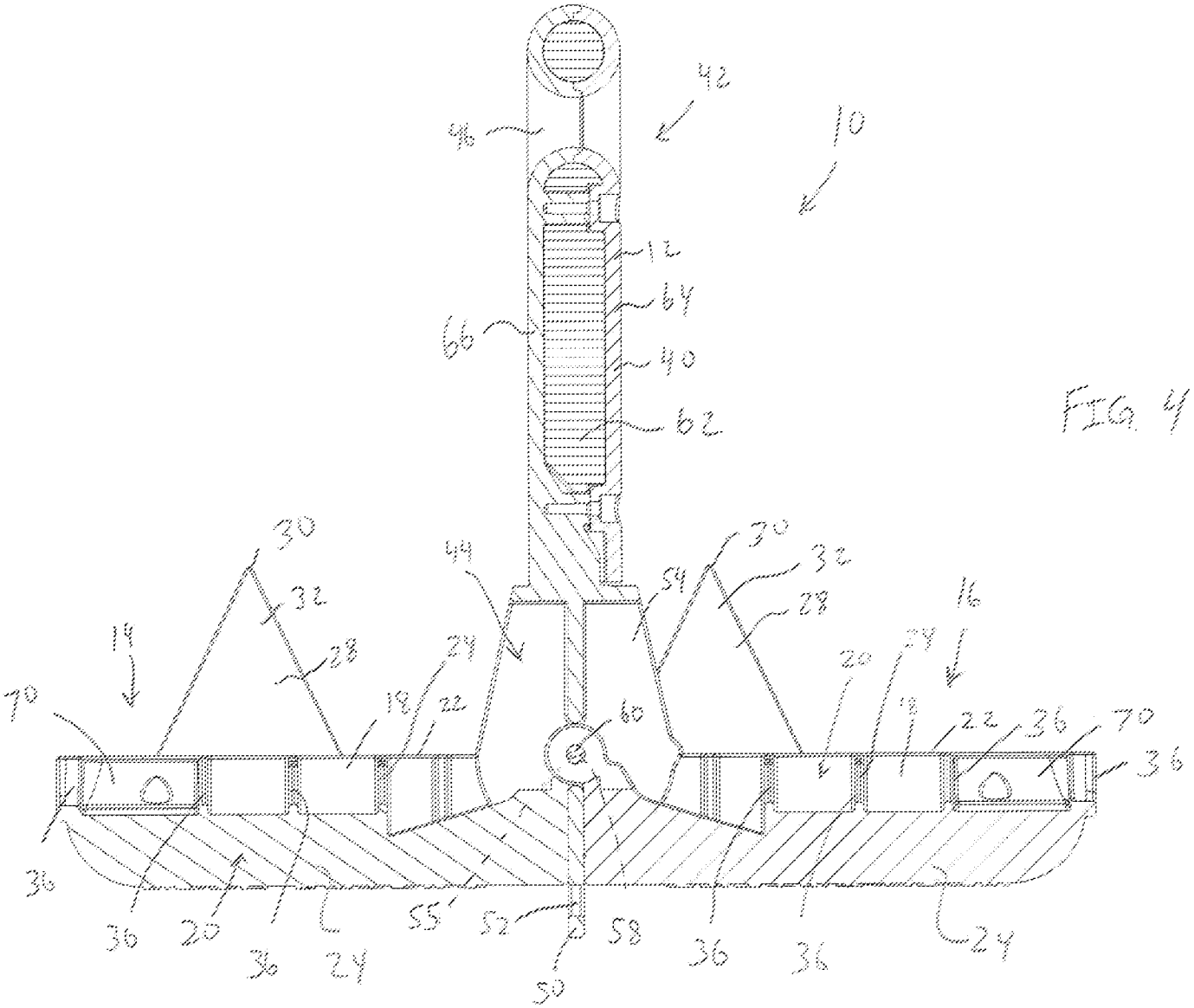
FIG. 4 is a side cross-section of the anchor of FIG. 2.
Figure 5:
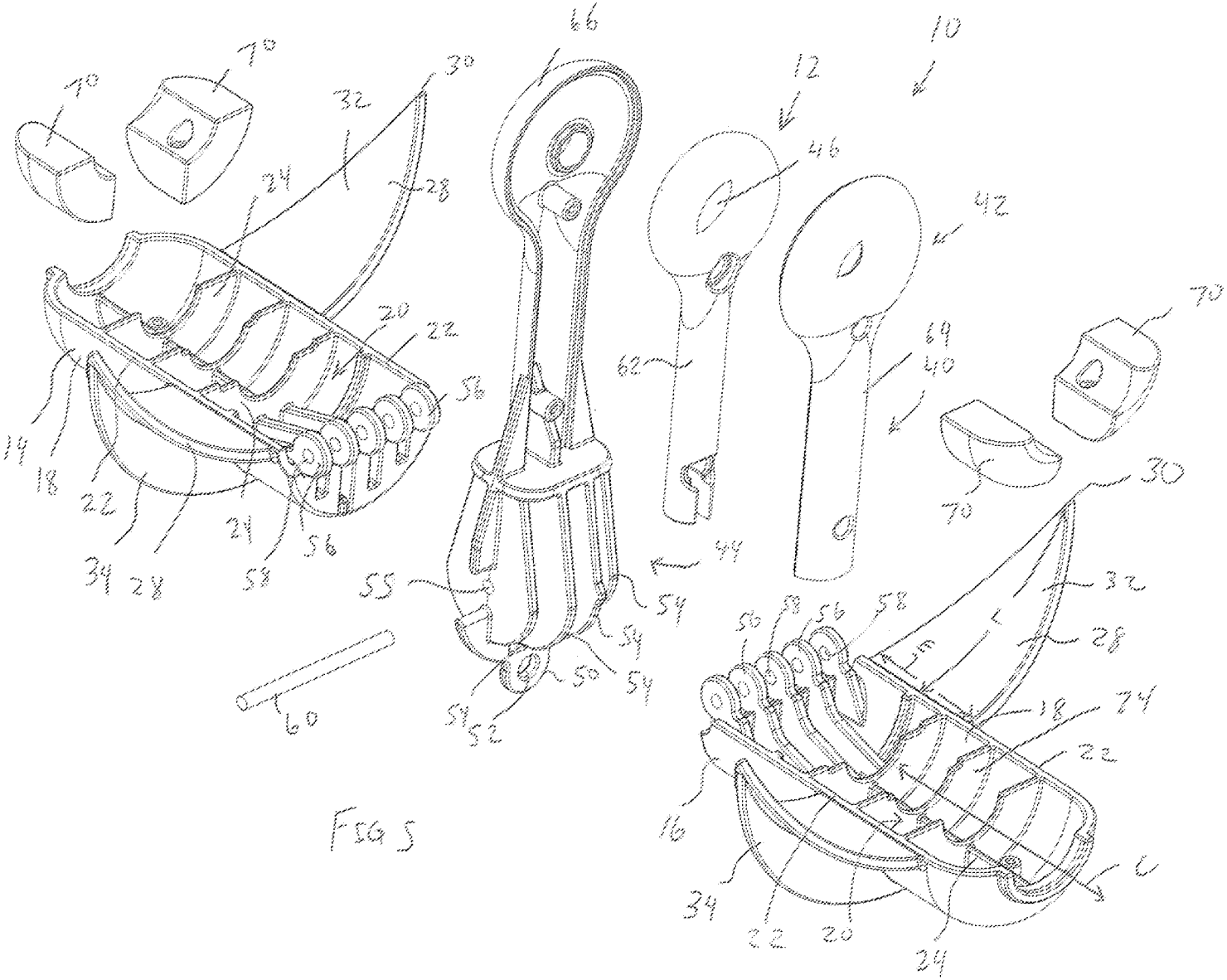
FIG. 5 is an exploded view of the anchor of FIG. 2.

Each cavity 20, besides being positioned and configured to receive sand or other loose debris when in the open position, can be configured to at least partially receive the body member 12 therein when each arm 14, 16 is in the closed position. In particular, as can be seen in FIGS. 2, 3 and 5, each stiffening rib 24, and/or the end of each arm 14, 16 can include a cutout or recess 36 (a semicircular cutout in the illustrated embodiment) to receive the (cylindrical, in the illustrated embodiment) corresponding portion of the body member 12 therein. Each arm 14, 16/recess 34 may extend radially about 180 degrees, or at least about 110 degrees in one case, or at least about 150 degrees in another case, to provide sufficient storage volume. In this manner, when the arms 14, 16 are in their closed positions, the anchor 10 is in a compact position and occupies less space, and is more easily stored and shipped. In addition, when the arms 14, 16 are all in their closed positions, they can be located immediately adjacent to each other at their outer edges 22 and/or distal ends, and together generally encapsulate the body member 12 to provide protection and a generally smooth, continuous outer surface to the anchor 10/body member 12.

With reference to FIG. 2, the body member 12 can be generally "dog-bone" shaped having a central stem 40, a first end 42 and a second end 44 located at an opposite end relative to the first end 42. The first end 42 has a line opening 46 to receive a line 48 (see FIG. 1), and the second end 44 of the body can also include a protrusion 50 having a supplemental line opening 52 formed therethrough in case it is desired to attach the line 48 to the lower end of the body member 12/anchor 10.

With reference to FIG. 5, the second end 44 of the body member 12 can have a plurality of parallel, spaced ribs 54, where each rib 54 includes an opening 55 extending therethrough at a base end thereof. Each arm 14, 16 can include a set of circular protrusions 56 at a base end thereof, each protrusion 56 having an opening 58 formed therethrough. Each arm 14, 16 can be coupled to the central body member 12 by aligning the circular protrusions 56 with the ribs 54 such that the openings 55, 58 are aligned. A pin 60 is then passed through the aligned openings 55, 58 and secured in place, such as by forming/attaching an enlarged head (not shown) to each opposed end of the pin 60. In this manner, the arms 14, 16 can be pivotally coupled to the body member 12, and pivotable about a common axis A. However if desired each arm 14, 16 can be attached and/or pivotable about its own, separate axis. Each arm 14, 16 can in one case be freely pivotable along its full range of motion, but in other cases the arms 14, 16 and/or body member 12 may include detents or the like located at or adjacent to the protrusions 56 and/or ribs 54 so that the arms 14, 16 are more securely held in certain positions, such as the open and closed positions.

With continued reference to FIG. 5, the body member 12 can include a body insert 62 received therein and trapped by two clamshell portions 64, 66. The clamshell portions 64, 66 can be made of a relatively lightweight, inexpensive material that is easy to mold, shape and/or manufacture, such as a polymer, plastic or composite material in one case. In one case the clamshell portions 64, 66 can have a density of less than about 2 g/cm$^3$ in one case, or less than about 1.5 g/cm$^3$ in yet another case. The body insert 62 can be made of a relatively heavy/dense material that is denser than the clamshell portions 64, 66, such as metal or stone (having a density of at least about 3 g/cm$^3$ in one case, or at least about 5 g/cm$^3$ in another case, or at least about 8 g/cm$^3$ in yet another case) to provide additional weight to the anchor 10/body member 12 and ensure that the anchor 10 quickly and effectively sinks in water, and to aid in the anchoring effect of the anchor 10.

Each arm 14, 16 (or a majority of each arm 14, 16), such as the outer shell 18 and/or ribs 24 can be made of the same materials having the same properties as the clamshell portions 64, 66 of the body member 12 (e.g. polymer, plastic or composite material in one case). If desired, each arm 14, 16 can include an arm insert or inserts 70 coupled to the outer/distal ends of each arm 14, 16. The arm inserts 70 can be made of a relatively heavy/dense material, and can be made of the same material and/or have the same density as the body insert 62 outlined above. The arm inserts 70 can help to ensure the arms 14, 16 move to and/or remain in their open position, due to gravitational forces, when the anchor 10 is in use.

When in use, the anchor 10 is coupled to the line 48 which is coupled to the anchor 10 at one end and to a watercraft at the other end. In one case the line 48 can be made of, or include a portion made of, a relatively elastic material that can, for example be stretched along its length and expand its length by at least about 10% in one case (e.g. 10% elongation), or at least about 20% in another case, or at least about 30% in yet another case, but less than 70% in one case, and return to its original shape/length when stretching forces are removed. In one case, the line 48 or the elastic portion thereof can be made of or include bungee cord material such as natural rubber, manufactured/synthetic rubber or a combination of both covered by a sheath made of for example nylon or cotton.

Providing a line 48 having the elasticity described above can help improve the functionality of the anchor 10. In particular, when the anchor 10 is dragged across an anchor surface 29, the anchor 10 may temporarily catch on a surface, and the elastic portions of the line 48 can stretch and thereby increase tension on the line 48. When a sufficient tension level is reached, the anchor 10 may thereby be jerked in the forward direction, causing the protrusions 28 and/or edges 22 to direct sand or other loose debris into the cavities 20 and/or causing the protrusions 28 to wedge into the anchor surface 29. In this manner, the anchor 10 can move in a jerking or "fit-and-start" manner until the anchor 10 is finally sufficiently secured/locked in place on the anchor surface 29. This jerking motion is particularly useful in directing sand or loose debris to be disturbed and moved into the cavities 20, and/or wedging the anchor 10 in place due to (temporarily) increased speed of the anchor 10 as it is dragged across the anchor surface 29. However it should be understood that the anchor 10 need not necessarily be used with a line 48 that is elastic.

Accordingly, the anchor 10 disclosed herein can be relatively lightweight, easy to manufacture, and movable to a closed position wherein the anchor 10 is relatively compact. Once in its use position, the anchor 10 provides an effective securing structure.

Although the invention is shown and described with respect to certain embodiments, it should be clear that modifications will occur to those skilled in the art upon reading and understanding the specification, and the present invention includes all such modifications.

The invention claimed is:

1. An anchor system comprising an anchor having:

a body member;

a first arm pivotally coupled to the body member and movable between a closed position wherein the first arm is positioned adjacent to the body member and an open position wherein at least part of the first arm is spaced away from the body member; and a second arm pivotally coupled to the body member and movable between a closed position wherein the second arm is positioned adjacent to the body member and an open position wherein at least part of the second arm is spaced away from the body member, wherein at least one of the first or second arms has a cavity that is exposed when the at least one of the first or second arms is in the open position, and wherein the at least one of the first or second arms includes a protrusion extending therefrom.

2. The system of claim 1 wherein the protrusion is configured and positioned to cause sand or other loose debris to be directed into the cavity by the protrusion when the at least one of the first or second pivot arms is its open position and when the anchor is dragged across an anchor surface.

3. The system of claim 1 wherein the protrusion is positioned immediately adjacent to the cavity and oriented generally perpendicular to a length of the cavity.

4. The system of claim 1 wherein a major face of the protrusion is oriented generally perpendicular to an axis of the body member when the at least one of the first or second arms is in the open position.

5. The system of claim 1 wherein the protrusion has a pointed tip and is configured and positioned to dig into sand or other loose debris when the at least one of the first or second arms is its open position and when the anchor is dragged across an anchor surface.

6. The system of claim 1 wherein the cavity has an outer edge that is configured to be oriented generally parallel to an anchor surface when the at least one of the first or second arms is its open position and when the anchor is dragged across the anchor surface to cause sand or other loose debris to be directed into the cavity.

7. The system of claim 1 wherein the protrusion is generally triangular in front view and has a length equal to at least about half of a length of the body member.

8. The system of claim 1 wherein the body member has an axis, and wherein the protrusion is generally curved about a length thereof and has an axis of curvature that is oriented generally perpendicular to the axis when the associated arm is in the open position.

9. The system of claim 1 wherein a largest surface of the protrusion is curved about an axis oriented generally perpendicular to an axis about which the at least one of the first or second arms is pivotable, and wherein the protrusion includes a stiffening rib positioned generally perpendicular to the largest surface thereof.

10. The system of claim 1 wherein the at least one of the first or second arms includes a supplemental protrusion extending therefrom, wherein the supplemental protrusion is positioned on an opposite side of the cavity relative to the protrusion.

11. The system of claim 10 wherein the protrusion and the supplemental protrusion are offset along a length of the at least one of the first or second arms.

12. The system of claim 1 wherein the cavity is configured to at least partially receive the body member therein when the at least one of the first or second arms is in the closed position.

13. The system of claim 1 wherein first and second arms together generally encapsulate the body member therein when the first and second arms are both in the closed positions.

14. The system of claim 1 wherein each arm is oriented generally parallel to the body member when each arm is in the closed position, and wherein each arm is oriented generally perpendicular to the body member when each arm is in the open position, and wherein each arm pivots about ninety degrees in moving between its open and closed positions.

15. The system of claim 1 wherein the other one of the first or second arms has a cavity that is exposed when the other one of the first or second arms is in the open position, and wherein the other one of the first or second arms includes a protrusion extending therefrom.

16. The system of claim 1 wherein the body member includes an outer shell and a body member insert positioned in the outer shell that is made of a material having a higher density than a material of the outer shell, wherein each arm includes an arm insert located at a distal end that is made of a material having a higher than density than a material of a remainder of the arm, and wherein the body member includes an opening configured to receive a line therethrough.

17. The system of claim 1 further comprising an line coupled to the anchor at one end thereof and to a watercraft at the other end thereof, wherein the line includes at least a portion having an elasticity to provide at least about 10% elongation thereof.

18. An anchor comprising:

a body member; and an arm pivotally coupled to the body member and movable between a closed position wherein the arm is positioned adjacent to the body member and an open position wherein at least part of the arm is spaced away from the body member, wherein the arm has a cavity that is exposed when the arm is in the open position, and wherein the arm includes a protrusion extending therefrom and oriented generally perpendicular to a length of the arm.

19. An anchor comprising:

a body member having an axis; and an arm pivotally coupled to the body member and movable between a closed position wherein the arm is oriented generally parallel to the axis and an open position wherein the arm is oriented at an angle relative to the axis, wherein the arm has a cavity that is exposed when the arm is in the open position, and wherein the arm includes a protrusion extending therefrom that is oriented generally perpendicular to the axis when the arm is in the open position.

* * * * *